US009857052B2

(12) United States Patent
Mallory et al.

(10) Patent No.: US 9,857,052 B2
(45) Date of Patent: Jan. 2, 2018

(54) LINEAR AISLE LIGHT OPTIC FOR LEDS

(71) Applicant: CoreLED Systems, LLC, Livonia, MI (US)

(72) Inventors: Derek Mallory, Plymouth, MI (US); Brian C. Wells, Grosse Pointe Farms, MI (US)

(73) Assignee: CoreLED Systems, LLC, Livonia, MI (US)

( * ) Notice: Subject to any disclaimer, the term of this patent is extended or adjusted under 35 U.S.C. 154(b) by 252 days.

(21) Appl. No.: 14/620,830

(22) Filed: Feb. 12, 2015

(65) Prior Publication Data

US 2016/0238202 A1 Aug. 18, 2016

(51) Int. Cl.

| | |
|---|---|
| ***F21V 5/04*** | (2006.01) |
| *F21Y 103/10* | (2016.01) |
| *F21Y 115/10* | (2016.01) |
| *F21K 9/69* | (2016.01) |

(52) U.S. Cl.

CPC ..... *F21V 5/04* (2013.01); *F21K 9/69* (2016.08); *F21Y 2103/10* (2016.08); *F21Y 2115/10* (2016.08)

(58) Field of Classification Search

CPC .... F21V 5/04; F21Y 2103/10; F21Y 2115/10; F21K 9/69

See application file for complete search history.

(56) References Cited

U.S. PATENT DOCUMENTS

| | | | | |
|---|---|---|---|---|
| 4,941,072 | A * | 7/1990 | Yasumoto | F21S 48/2237 355/70 |
| 5,607,227 | A * | 3/1997 | Yasumoto | H04N 1/00909 257/100 |
| 6,450,664 | B1 * | 9/2002 | Kelly | F21V 5/045 362/218 |
| 6,659,623 | B2 * | 12/2003 | Friend | F21V 21/002 250/504 R |
| 7,580,192 | B1 * | 8/2009 | Chu | F21V 5/04 359/641 |
| 9,518,716 | B1 * | 12/2016 | Householder | F21V 5/04 |
| 2009/0190348 | A1 * | 7/2009 | Lin | F21S 6/003 362/235 |
| 2010/0020542 | A1 * | 1/2010 | Teng | F21V 5/043 362/249.05 |

(Continued)

*Primary Examiner* — Mary Ellen Bowman

(74) *Attorney, Agent, or Firm* — Butzel Long

(57) ABSTRACT

An optical element for uniformly dispersing light from a plurality of linearly aligned LEDs includes a body made of a transparent polymeric material, in which the body has a longitudinally extending center portion having a transverse cross-sectional profile that is uniform along the length of the optical element, and legs extending away from opposite sides of the center portion and extending downwardly to define a recess. The center portion has a top surface and a bottom surface that together define a longitudinally extending lens portion that collects light from the LEDs and refracts the light to produce a desired beam pattern. Uniformly and closely spaced apart transverse grooves can be provided on the top surface of the longitudinally extending lens portion to uniformly spread light on an illuminated surface and eliminate the appearance of dark and light areas on the lens portion when it is illuminated by the LEDs.

21 Claims, 3 Drawing Sheets

(56) References Cited

U.S. PATENT DOCUMENTS

| | | | | |
|---|---|---|---|---|
| 2010/0271818 | A1* | 10/2010 | Smith | B60Q 1/2611 362/235 |
| 2011/0149548 | A1* | 6/2011 | Yang | F21V 5/04 362/84 |
| 2011/0149581 | A1* | 6/2011 | Jiang | F21V 3/04 362/338 |
| 2012/0087122 | A1* | 4/2012 | Takeuchi | G02F 1/133603 362/235 |

* cited by examiner

LINEAR AISLE LIGHT OPTIC FOR LEDS

CROSS-REFERENCE TO RELATED APPLICATIONS

Not applicable.

FIELD OF THE DISCLOSURE

This disclosure relates to optical elements for collecting and refracting light and more particularly to such elements used in luminaires and lighting fixtures.

BACKGROUND OF THE DISCLOSURE

There is a demand for energy efficient commercial lighting fixtures and luminaires that provide a combination of lighting qualities (e.g., operating cost, color rendering, uniformity of lighting, etc.) comparable to or better than conventional incandescent or fluorescent lighting fixtures. LEDs already exhibit excellent qualities for commercial applications, including long life, high energy efficiency and satisfactory to good color rendering. However, commercial applications have generally required a multitude of individual LEDs, each of which is associated with an individual lens element or lens portion of a composite optical element having a plurality of integrally formed individual lens portions. The cost of molding articles is highly dependent on the number of features that need to be incorporated into a mold die to produce a shaped article. Therefore, it would be desirable to provide a multiple LED optical element having an improved geometry that reduces the cost of molding the optical elements and consequently reduces the overall cost of LED lighting fixtures and luminaires, thereby promoting conversion to more energy efficient LED lighting in various commercial applications, such as warehouses, supermarkets, home improvement stores, and other so called "big-box stores."

SUMMARY OF THE DISCLOSURE

The disclosed optical element provides a simpler geometry that can achieve uniform dispersion of light from a plurality of linearly aligned LEDs at a lower cost.

The optical elements of this disclosure are shaped from an optically transmissive polymeric material to produce a body having length, width and depth, wherein the length is greater than each of the width and the depth. Unlike conventional optical elements for multiple LEDs, which have an individual lens portion for each LED, the optical element of this disclosure has a substantially uniform transverse cross-sectional profile. The body includes a longitudinally extending central portion and legs extending in the width direction away from opposite sides of the central portion and extending downwardly in the depth direction to allow mounting of the body on a substrate with a light emitting surface of an LED positioned in a recess defined between the substrate and the body. The central portion has a top surface and a bottom surface that together define a longitudinally extending lens portion that is capable of collecting light from an LED and refracting the light to produce a narrower beam pattern than that of the LED.

In certain aspects of this disclosure, the optical element is used in a luminaire. The luminaire includes a substrate and a plurality of linearly aligned LEDs mounted on the substrate and operatively connected to a power source. The optical element described herein is mounted over the LEDs and on to the substrate so that the light emitting surface of the LED is disposed between the substrate and the optical element, and the light emitting surface faces the optical element.

DETAILED DESCRIPTION OF ILLUSTRATED EMBODIMENTS

Figure 1:
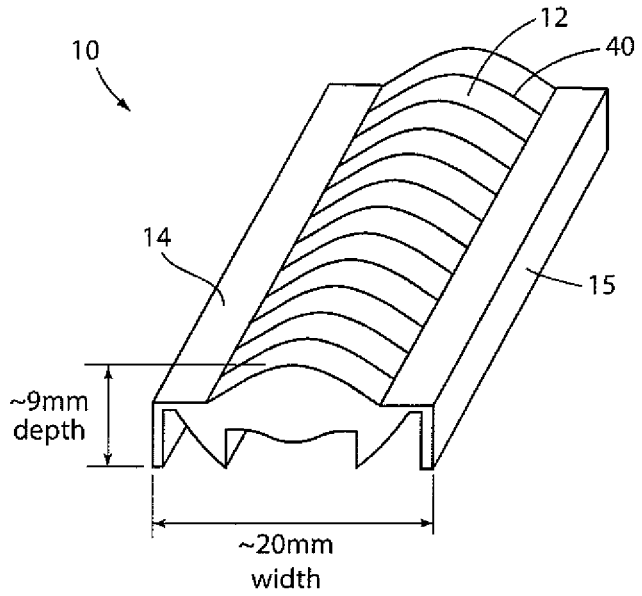
FIG. 1 is a perspective view of an optical element in accordance with this disclosure.

A perspective view of an optical element 10 for dispensing light from a plurality of linearly aligned LEDs is shown in FIG. 1. The term optical element as used herein can refer to a component of a luminaire that includes a lens or optical portion that is transparent to visible light and shaped to collect and refract light emitted from an LED to provide a narrower beam of light than that produced by the LED.

Optical element 10 can be formed or shaped from optically transmissive or transparent polymeric materials that allow visible light to be transmitted through the material without appreciable absorption or scattering. Examples of suitable transparent polymeric materials that can be used to form optical element 10 include polymethylmethacrylate, polystyrene, polystyrene acrylonitrile (SAN), polycarbonate, polymethylpentene, polyamide, polyacrylate, polysulfone, polystyrene-co-butadiene, polycyclohexylmethacrylate, polyallyl diglycol carbonate, cellulose acetate butyrate, polyethersulfone, polychlorotrifluoroethylene, polyvinylidene fluoride, polyetherimide, and polysiloxanes.

Optical element 10 can be made by molding or extruding a suitable transparent material to form or shape a body having an elongate shape with a substantially uniform transverse cross-sectional profile. An "elongate shape" means that the shaped body has a length direction and an associated length that is greater than the width of the body, and greater than the depth or thickness of the body. In a particular application suitable for use in a fixture sized and designed to replace a conventional 2 foot by 4 foot fluorescent troffer, the optical element is 12 inches (304.8 mm) long, about 20 mm wide, and has a thickness or depth of about 9 mm.

Figure 2:
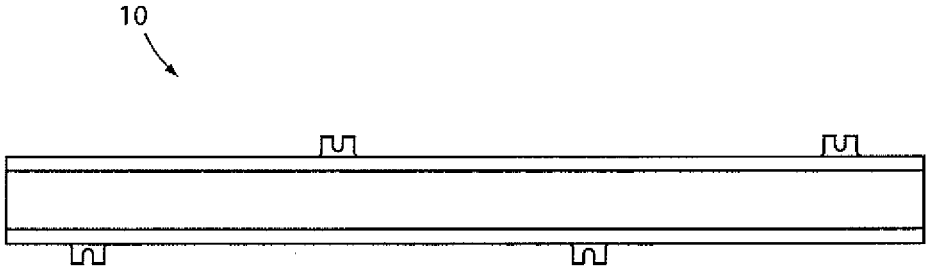
FIG. 2 is a top plan view of the optical element shown in FIG. 1.
Figure 3:
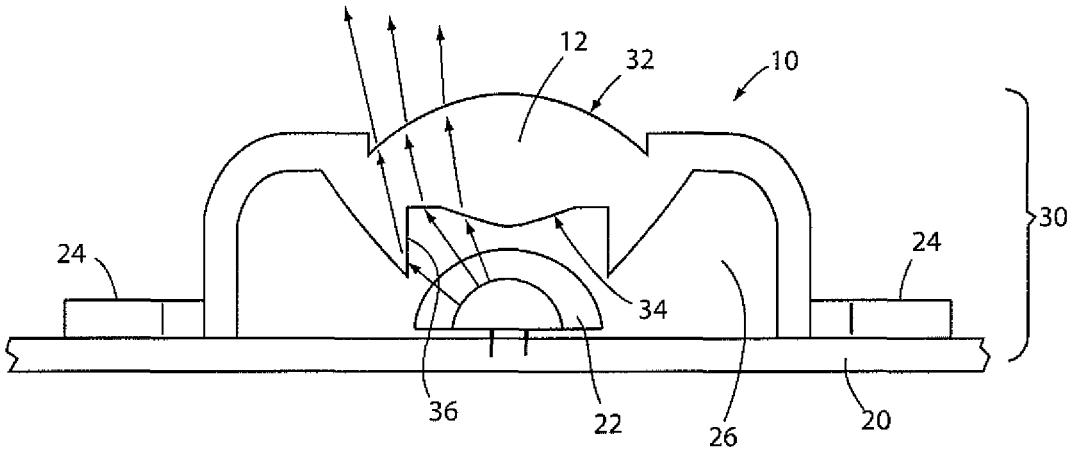
FIG. 3 is a cross-sectional view of a luminaire employing the optical element shown in FIG. 1.

The molded or extruded body, or optical element 10, includes a longitudinally extending center portion 12 and leg portions 14, 15 that extend away from opposite sides of the center portion in the width direction and downwardly in the depth direction. The legs 14, 15 facilitate mounting of the body or optical element 10 to a substrate 20 on which a plurality of linearly aligned LEDs 22 are mounted, as shown in FIG. 3. Legs 14, 15 support center portion 12 over the LEDs 22. Lugs 24, as shown in FIG. 2, can be provided to help facilitate attachment of optical element 10 to substrate 20, such as with screws. Substrate 20, shown in FIG. 3, can be a printed circuit board supporting electronic components and having conductive tracks that facilitate an operative electrical connection to a power source. An optical element 10 with lugs 24 can be made using conventional molding techniques, e.g., injection molding, or by employing machining operations on an extruded body to form lugs or fastener openings on peripheral flanges extending perpendicularly outward from the bottom of legs 14, 15. Alternatively, optical element 10 can be clamped to substrate 20 without use of fastening lugs 24 or openings in a flange portion.

Figure 4:
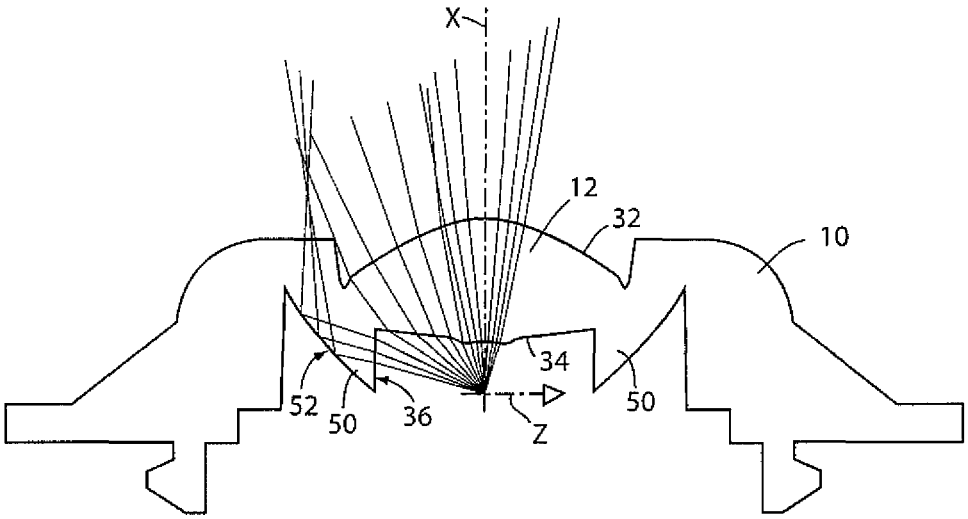
FIG. 4 is a cross-sectional view showing large angle light rays from the LED being redirected into a desired beam pattern by a wedge element via total internal reflection.

The underside of optical element 10 defines a recess, and together with substrate 20 forms a cavity or void 26. Linearly aligned LEDs 22 are positioned within cavity 26 (FIG. 3) in a luminaire 30 generally defined by substrate 20 and lens element 10. The LEDs 22 are located under the center or optic portion 12 of optical element 10. Optic portion 12 has a top surface 32 and a bottom surface 34. Top and bottom surfaces 32 and 34 together define a longitudinally extending lens portion that collects light from LEDs 22 and refracts the light to produce a beam pattern that is narrower than that produced by the LEDs alone. The top surface 32 and/or the bottom surface 34 can be convex (e.g., a circular or parabolic curvature). Substantially planar wall 36 can extend downwardly from each of opposite side edges of the bottom convex surface 34 to intercept and reflect laterally propagating light rays toward surface 34. Walls 36 can be perpendicular to the width direction of the formed body or optical element 10. The light rays that are emitted from the LED at a high angle relative to vertical axis X (FIG. 4) are reflected back into the desired beam pattern by total internal reflection at the wedge shaped portion 50 defined by vertical wall 36 and angled wall 52.

The surfaces 32 and 34 of the optic portion or center portion 12 of optical element 10 can concentrate and uniformly distribute light from the LEDs with a desired beam pattern with respect to the lateral or width direction of the optical element. However, a more uniform distribution of light with respect to the longitudinal direction of the optical element can be achieved by providing the upper surface 32 of optic portion 12 with a plurality of transverse grooves 40 (i.e., grooves that extend across surface 32 in a direction perpendicular to the longitudinal direction of the optical element 10). The grooves 40 can be uniformly spaced apart (centerline to centerline) by a distance of about 1 mm to about 3 mm, with the width of the grooves being less than 1 mm or less than 0.5 mm. The ridges defined between the grooves can be wider than the grooves. The grooves provide a fluted surface that improves the lighted luminous appearance of the optic, increasing the apparent size of the LED source by a factor of about 4. The grooves 40 can be formed in a molding operation or added to an extruded optical element 10 in a post-extrusion hot stamping operation.

In a luminaire 30, generally defined by a substrate 20 supporting LEDs 22 and lens element 10, the LEDs can be linearly aligned and uniformly spaced apart, such as by a distance of from about 0.3 inches (8 mm) to about 2 inches (51 mm). Closer spacing (e.g., less than 1 inch) reduces viewed luminance "spot effect" (contrasting dark and light areas) of the luminaire itself. However, at typical vertical distances between ceiling mounted aisle lighting fixtures and the floors and shelves at various big-box stores, there is very little or no discernible contrasting dark and light areas on the illuminated surfaces, irrespective of spacing between LEDs, provided the LEDs are linearly aligned along the center axis of the optic portion 12 of the optical element 10.

A suitable LED for use with the optical element 10 is generally any commercially available white LED, such as Nichia 757 white LED.

Figure 5:
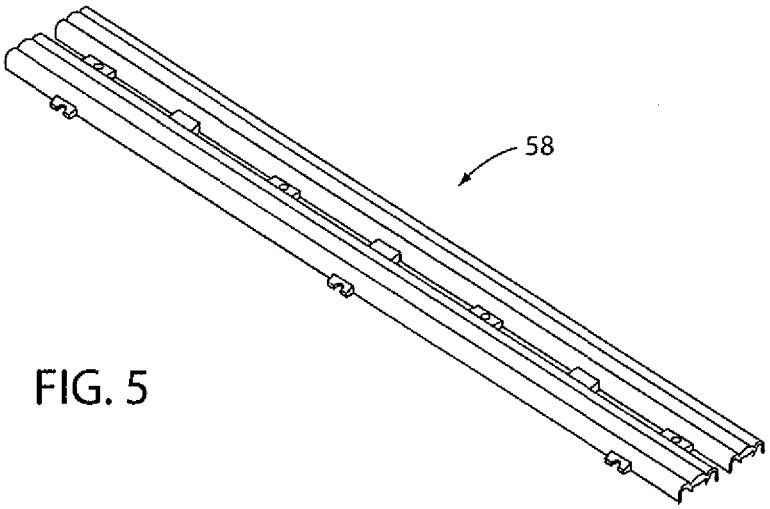
FIG. 5 is a perspective view of an alternate embodiment.
Figure 6:
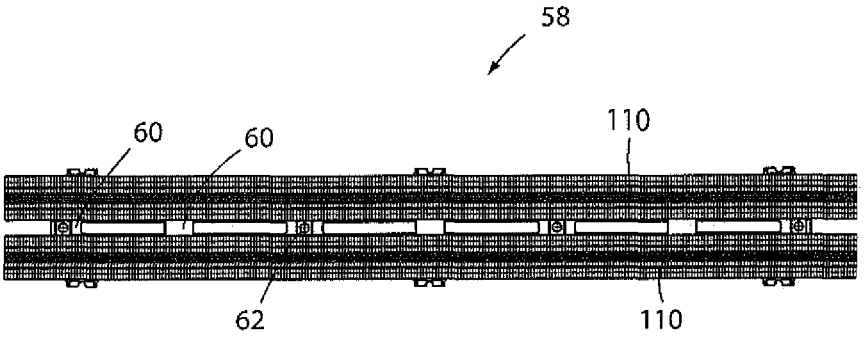
FIG. 6 is a top view of the embodiment shown in FIG. 5.
Figure 7:
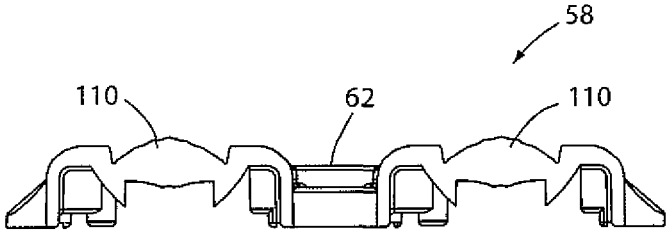
FIG. 7 is a cross-section of the embodiment shown in FIG. 5.

An alternate embodiment of the disclosed optical element is shown in FIGS. 5-7. In this embodiment, a plurality of optical elements 110 are molded together to form a compound optical structure 58 in which web segments 60 integrally join elements 110 together. Web segments 60 may be configured to define screw holes 62. In other respects, optical elements 110 can be substantially the same as optical elements 10.

While the present invention is described herein with reference to illustrated embodiments, it should be understood that the invention is not limited hereto. Those having ordinary skill in the art and access to the teachings herein will recognize additional modifications and embodiments within the scope thereof. Therefore, the present invention is limited only by the claims attached herein.

What is claimed is:

1. An optical element for uniformly dispersing light from a plurality of linearly aligned LEDs, comprising:

a shaped body made of an optically transmissive polymeric material, the body having length, width and depth, wherein the length is greater than each of the width and the depth, and wherein the body has a substantially uniform transverse cross-sectional profile, the body including a longitudinally extending center portion and optically transmissive legs extending in the width direction away from opposite sides of the center portion and extending downwardly in the depth direction to facilitate mounting of the body on a substrate with a light emitting surface of an LED positioned in a recess defined between the substrate and the body, the center portion having a top surface and a bottom surface that together define a longitudinally extending lens portion capable of collecting light from an LED and refracting the light to produce a beam pattern, wherein both the top surface and the bottom surface of the lens portion are convex.

2. The optical element of claim 1, in which a substantially planar wall extends downwardly from each of opposite side edges of the bottom convex surface.

3. The optical element of claim 2, in which the substantially planar walls are perpendicular to the width direction of the body.

4. The optical element of claim 1, in which the top surface of the lens portion has a plurality of transverse grooves and ridges.

5. The optical element of claim 4, in which the transverse grooves are uniformly spaced apart.

6. The optical element of claim 5, in which the uniform spacing between the grooves is from about 1 mm to about 3 mm.

7. A luminaire comprising:

a substrate;

a plurality of linearly aligned LEDs mounted on the substrate; and an optical element for uniformly dispersing light from the plurality of linearly aligned LEDs mounted on the substrate with a light emitting surface of the LED disposed between the substrate and the optical element, the optical element having a shaped body made of an optically transmissive polymeric material, the body having length, width and depth, wherein the length is greater than each of the width and the depth, and wherein the body has a substantially uniform transverse cross-sectional profile, the body including a longitudinally extending center portion and optically transmissive legs extending in the width direction away from opposite sides of the central portion and extending downwardly in the depth direction to facilitate mounting of the body on a substrate with a light emitting surface of an LED positioned in a recess defined between the substrate and the body, the center portion having a top surface and a bottom surface that together define a longitudinally extending lens portion capable of collecting light from an LED and refracting the light to produce a beam pattern, wherein both the top surface and the bottom surface of the lens portion are convex.

8. The luminaire of claim 7 in which the linearly aligned LEDs are spaced apart uniformly.

9. The luminaire of claim 7, in which a substantially planar wall extends downwardly from each of opposite side edges of the bottom convex surface.

10. The luminaire of claim 9, in which the substantially planar walls are perpendicular to the width direction of the body.

11. The luminaire of claim 7, in which the top surface of the lens portion has a plurality of transverse grooves and ridges.

12. The luminaire of claim 11, in which the transverse grooves are uniformly spaced apart.

13. The luminaire of claim 12, in which the uniform spacing between the grooves is from about 1 mm to about 3 mm.

14. A compound optical structure, comprising:

a plurality of optical elements integrally joined together by at least one web element, each of the optical elements having a shaped body made of an optically transmissive polymeric material, the body having length, width and depth, wherein the length is greater than each of the width and the depth, and wherein the body has a substantially uniform transverse cross-sectional profile, the body including a longitudinally extending center portion and optically transmissive legs extending in the width direction away from opposite sides of the center portion and extending downwardly in the depth direction to facilitate mounting of the body on a substrate with a light emitting surface of an LED positioned in a recess defined between the substrate and the body, the center portion having a top surface and a bottom surface that together define a longitudinally extending lens portion capable of collecting light from an LED and refracting the light to produce a beam pattern, wherein both the top surface and the bottom surface of the lens portion are convex.

15. The optical element of claim 1, wherein the shaped body further comprises wedge shaped portions extending downwardly from each of opposite sides of the bottom convex surface to allow total internal reflection of light emitted at a high angle relative to a vertical axis in the depth direction.

16. The luminaire of claim 7, wherein the shaped body further comprises wedge shaped portions extending downwardly from each of opposite sides of the bottom convex surface to allow total internal reflection of light emitted at a high angle relative to a vertical axis in the depth direction.

17. The compound optical structure of claim 14, wherein the shaped body further comprises wedge shaped portions extending downwardly from each of opposite sides of the bottom convex surface to allow total internal reflection of light emitted at a high angle relative to a vertical axis in the depth direction.

18. An optical element for uniformly dispersing light from a plurality of linearly aligned LEDs, comprising:

a shaped body made of an optically transmissive polymeric material, the body having length, width and depth, wherein the length is greater than each of the width and the depth, and wherein the body has a substantially uniform transverse cross-sectional profile, the body including a longitudinally extending center portion and optically transmissive legs extending in the width direction away from opposite sides of the center portion and extending downwardly in the depth direction to facilitate mounting of the body on a substrate with a light emitting surface of an LED positioned in a recess defined between the substrate and the body, the center portion having a top surface and a bottom surface that together define a longitudinally extending lens portion capable of collecting light from an LED and refracting the light to produce a beam pattern, wherein both the top surface and the bottom surface of the lens portion are convex and the shaped body further comprising a wedge shaped portion having substantially planar walls extending downwardly from each of opposite side edges of the bottom convex surface and angled walls that extend upwardly and outwardly from bottom edges of the planar walls to redirect light rays emitted from LEDs at a high angle relative to a vertical axis toward the top surface of the lens into a desired beam pattern by total internal reflection.

19. The optical element of claim 1, wherein lugs extend perpendicularly outwardly from the legs to facilitate attachment of the optical element to a substrate.

20. The optical element of claim 7, wherein lugs extend perpendicularly outwardly from the legs to facilitate attachment of the optical element to a substrate.

21. The optical element of claim 14, wherein lugs extend perpendicularly outwardly from the legs to facilitate attachment of the optical element to a substrate.

* * * * *